United States Patent [19]

Vollmer

[11] Patent Number: 4,666,416

[45] Date of Patent: May 19, 1987

[54] APPARATUS FOR PRODUCING CONSECUTIVE CONNECTIONS BETWEEN THE INTERIORS OF GLASS LAMP BULBS AND SOURCES OF PRESSURIZED GAS AND/OR VACUUM

[76] Inventor: Lothar Vollmer, Dipl.-Ingenieur
Karl-Marx-StraBe 181, D-1000
Berlin 44, Fed. Rep. of Germany

[21] Appl. No.: 799,908

[22] Filed: Nov. 20, 1985

[30] Foreign Application Priority Data

Nov. 20, 1984 [DE] Fed. Rep. of Germany ..... 3442362

[51] Int. Cl.[4] ..... H01J 9/46

[52] U.S. Cl. ..... 445/73; 445/71

[58] Field of Search ..... 445/73, 70, 71; 308/DIG. 8, DIG. 9; 384/907, 912

[56] References Cited

U.S. PATENT DOCUMENTS

| | | | |
|---|---|---|---|
| 1,708,756 | 4/1929 | Fagan | 445/71 |
| 2,247,513 | 7/1941 | Marshaus | 445/73 |
| 2,575,756 | 11/1951 | Fulton | 445/73 |
| 2,730,280 | 1/1956 | Spencer | 445/73 |
| 2,764,799 | 10/1956 | McGowan | 445/71 |
| 3,178,241 | 4/1965 | Braunagel | 384/907 |
| 3,796,475 | 3/1974 | Yamamoto | 445/73 |

FOREIGN PATENT DOCUMENTS

| | | | |
|---|---|---|---|
| 0014984 | 2/1978 | Japan | 445/73 |

*Primary Examiner*—Kurt Rowan
*Attorney, Agent, or Firm*—Hamilton, Brook, Smith & Reynolds

[57] ABSTRACT

The invention resides in apparatus for producing consecutive connections between the interiors (10) of glass lamp bulbs (12) and sources (14) of pressurized gas and/or vacuum (16, 17). The sequence of connecting is governed by the requirements of lamp bulb manufacturing. The pressure sources and/or vacuum sources are connected with channels (50, 52) in a stationary lower slide (38) of a slide system containing an upper slide (36) rotatable in engagement with the lower slide. Disposed in the upper slide are passageways (30, 32, 42, 43) to which the interiors of glass lamp bulbs are connected. Dependent on the position of rotation, the orifices of passageways (30, 32, 42, 43, 50, 52) in the upper and lower slides are aligned at least one of the two slides is provided with a face (60) engaging the other slide. The face is formed from a disc of a ceramic material which is highly resistant to wear and has a low coefficient of friction.

8 Claims, 4 Drawing Figures

APPARATUS FOR PRODUCING CONSECUTIVE CONNECTIONS BETWEEN THE INTERIORS OF GLASS LAMP BULBS AND SOURCES OF PRESSURIZED GAS AND/OR VACUUM

FIELD OF THE INVENTION

The invention relates generally to lamp bulb manufacturing and more specifically to an apparatus for producing consecutive connections between the interiors of glass lamp bulbs and sources of pressurized gases and/or vacuum in a sequence which is governed by the requirements of lamp bulb manufacturing.

BACKGROUND OF THE INVENTION

At a certain stage in the process of manufacturing glass lamp bulbs, for example, incandescent lamps connected to hollow glass tubes projecting like stems, also called "stem lamps", the interiors of the lamps are brought, by so-called pumping and vacuum machines, into a condition which is dependent upon the intended use of the lamp. In the case where the interior must be evacuated, the stem lamps are connected to a vacuum source. Thereafter, the stems are melted or otherwise sealed off. If the interior must be filled with a particular gas, it is subjected to a pumping-sweeping cycle and subsequently filled with gas under a predetermined pressure before the stem is melted off or sealed off.

The pumping machines are equipped with means for carrying out valve functions. One such means is a slide system having one circular lower slide (also called the "distributor" or "stator") and one circular upper slide (also called the "runner" or "rotor"). The sweeping and filling of the "stem lamps" is rendered possible in a sequence controlled by the arrangement of passageway openings formed in the upper and lower slides. The upper and lower slide each consists of a steel ring which has a generally planar surface area including the openings of the passageways.

During the sweeping, filling and evacuating of the interior of a glass bulb, corresponding passageways in the upper and lower slides are in communication. To switch over to other passageways, the upper slide rotates on the lower slide. The upper slide may, however, also be rotated continuously, whereby the openings of the passageways in the upper and lower slides will overlap for only a short time.

The engaging surfaces of the upper and lower slides are covered by an oil film to seal the communicating, or for a short time, overlapping openings of the passageways. This also reduces the friction between upper and lower slides.

The stems of the "stem lamps" project into holders, each of which is surrounded by a cylindrical housing, called the "pump connecting piece". The pump connecting piece is connected to passageways in the upper slide, or rotor, which ultimately communicate with the sweeping or filling gas or vacuum sources.

With oil-sealed slides, the oil creating the sealing film can be carried along by the gases, in particular at high speed operation of the sweeping and filling apparatus or during a process called "blowing-out" or "clean-blowing". In addition, there is the danger that oil can accumulate in the connecting passageways. When filling the stem lamps, oil vapors may form which can enter the interior of the lamp bulb along with the gas. In such case, oil is in the closed bulb after the melting-off or sealing-off of the stem. During normal usage, oil inclusions in the lamps heighten the risk of a premature failure of the lamps.

It is an object of this invention to improve an apparatus of the type described above such that no oil can get into the interior of the lamp bulbs.

SUMMARY OF THE INVENTION

As a result of this invention, oil is no longer needed for lubricating and for sealing the opposing or, for a short time, overlapping openings of the passageways in the upper and lower slides. No control of oil consumption and no refilling of oil is necessary. Moreover, it is not necessary to examine the respective oil supplies to keep the same consistency as initially selected as being favorable. Due to the absence of oil, lamps of steady quality can be produced.

There are certain ceramic materials, preferredly zirconium dioxide or alumina, which are extremely resistant to wear and show a low coefficient of friction with the same or other materials, in particular, sliding friction. One circular slide is provided with a ceramic surface having two grooves which extend around the slide close to its outer and inner edge, the grooves open towards the opposite slide and are connected to a vacuum source through appropriate bores or passageways. This mechanism assures that the passageways provided for sweeping and filling are protected against the penetration of atmosphere in the area where the surfaces of the upper and lower slide engage one another. It further prevents the contamination of the gases which fill lamp bulb by undesired additives combining with the sweeping and filling gases.

Preferably the ceramic surface is formed on one side of a ceramic disc which is secured to the lower slide. In this embodiment, the ceramic disc is stationary as is the lower slide. Because of the use of the ceramic disc, it is not necessary to oil seal any member which is in slidable contact with it. The connecting leads between the grooves in the sliding surface on the ceramic disc and the vacuum source serve as a vacuum condiut to help draw the sliding members together.

Preferably, the ceramic disc is fastened with adhesive to the upper surface of the lower slide. Hence, no major expense is required for fixing the ceramic disc to the lower slide.

The bottoms of the grooves are provided with uniformly spaced orifices of passageways which extend to grooves in the lower slide beneath the grooves in the ceramic disc. The latter are connected with the vacuum source. By this arrangement an especially good sealing effect is achieved all over the region adjacent the respective grooves. The grooves in the lower slide preferably have a larger cross section than the grooves in the ceramic disc. This creates more favorable conditions of flow, i.e., air is drawn through any gaps between the sliding surface of the ceramic disc and the upper slide.

The above and other features of the invention including various novel details of construction and combinations of parts will now be more particularly described with reference to the accompanying drawings and pointed out in the claims. It will be understood that the particular pressure and a vacuum connecting mechanism embodying the invention is shown by way of illustration only and not as a limitation of the invention. The principles and features of this invention may be employed in varied and numerous embodiments without departing from the scope of the invention.

BEST MODE FOR CARRYING OUT THE INVENTION

Figure 1:
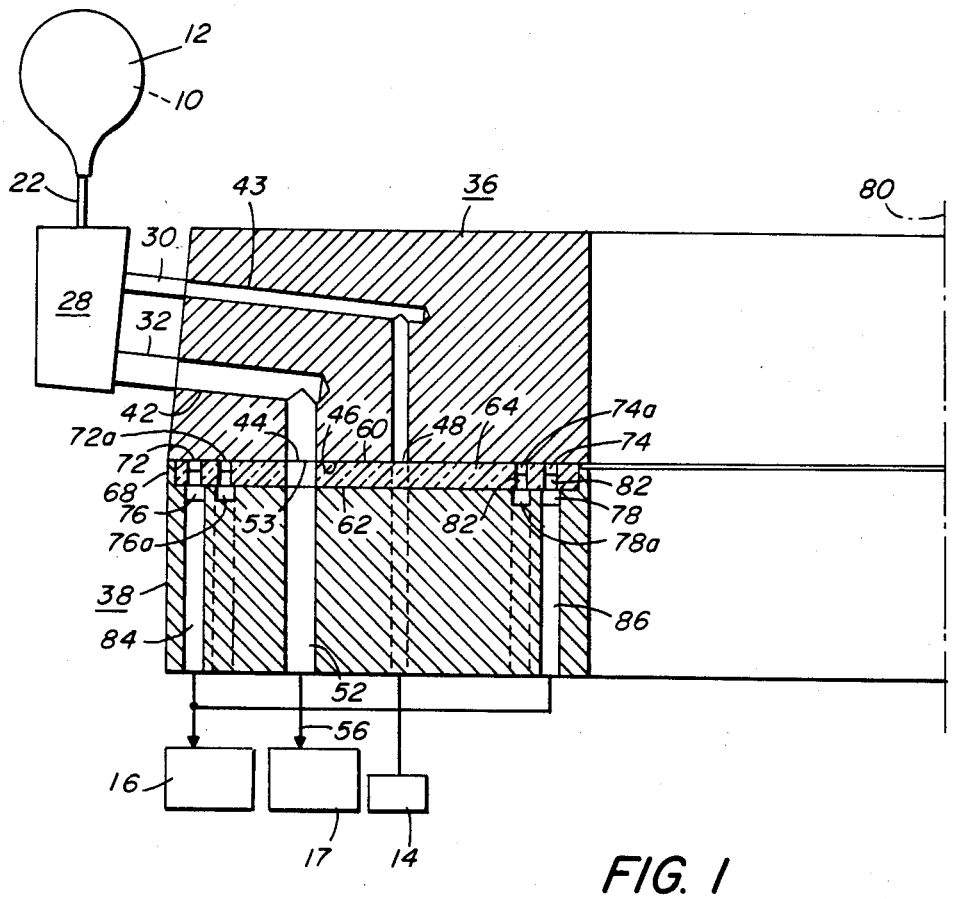
FIG. 1 is a schematic vertical sectional view through one-half of apparatus for producing consecutive connections between the interior of glass lamp bulbs and sources of pressurized gas and/or vacuum.
Figure 2:
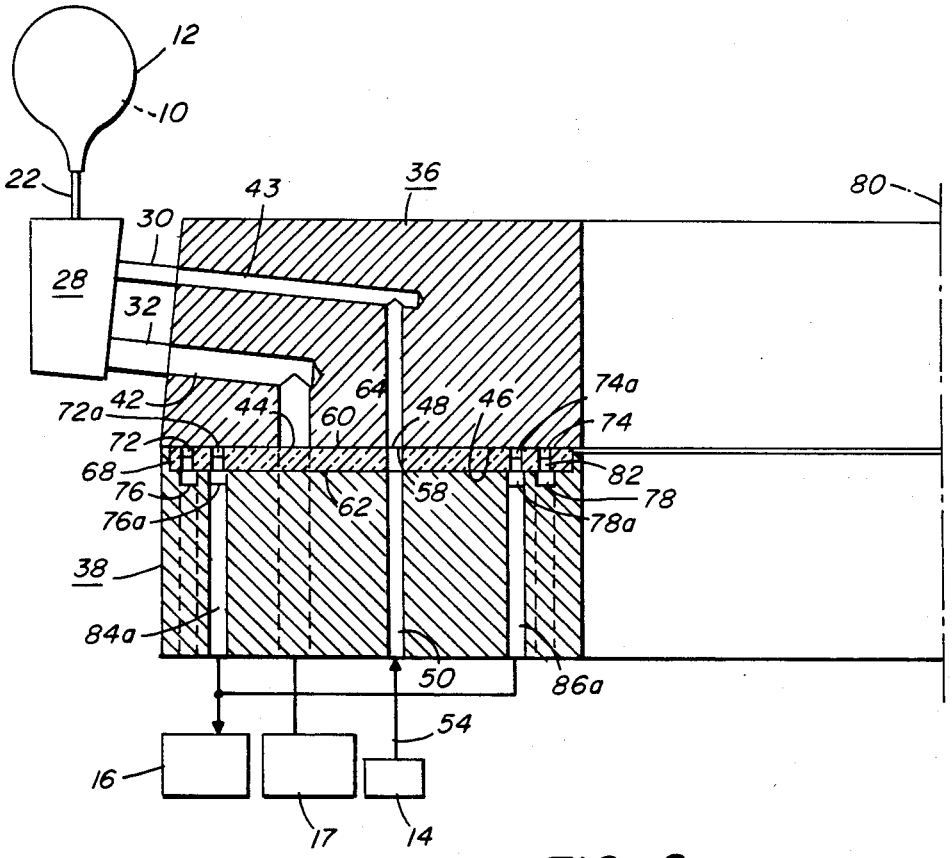
FIG. 2 is a view similar to FIG. 1 with the apparatus in another position.
Figure 4:
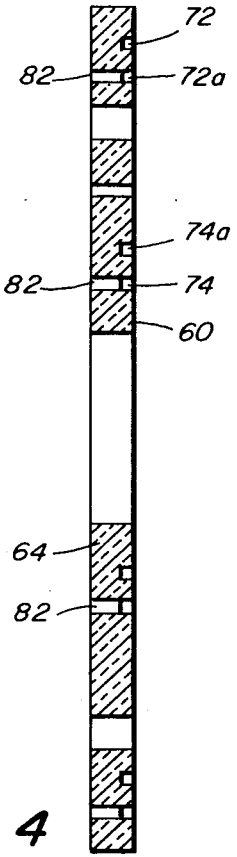
FIG. 4 is a sectional view taken on the line IV—IV of FIG. 3.
Figure 3:
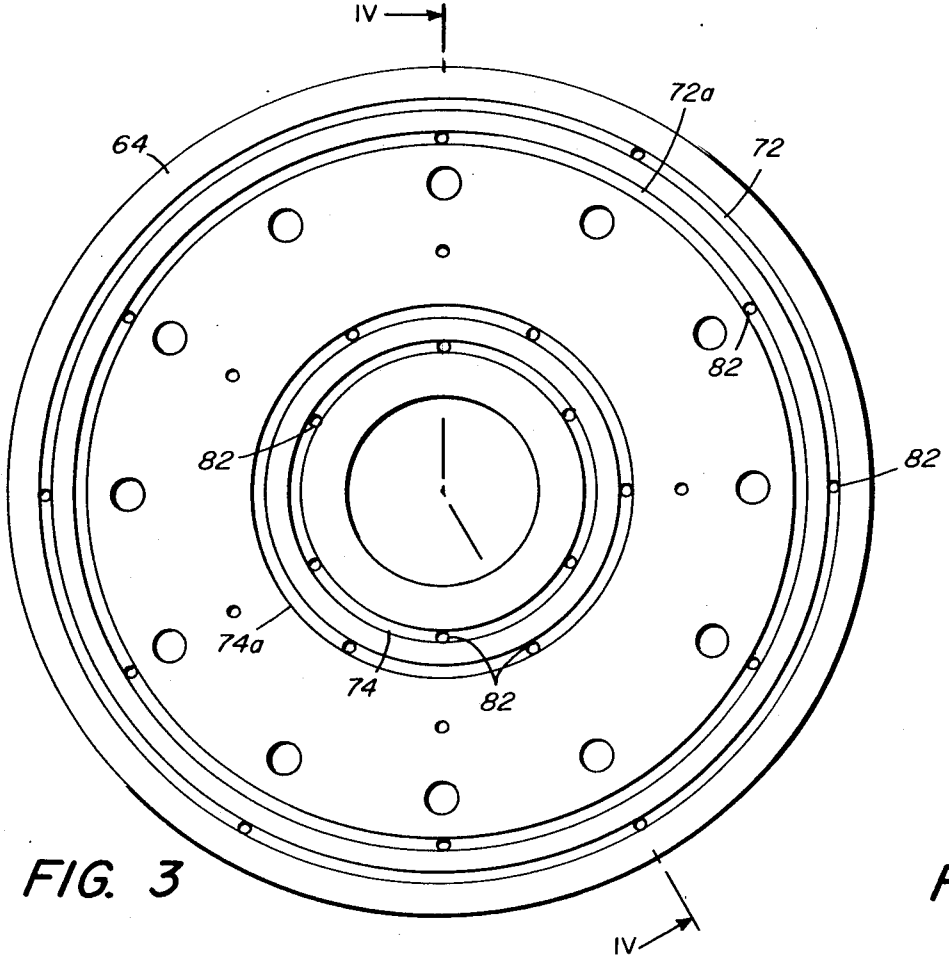
FIG. 3 is a plan view on a reduced scale of the apparatus of FIG. 1.

Apparatus for producing consecutive connections between the interior 10 of a glass lamp bulb 12 and a sweeping gas and vacuum source 16, 17 will be seen in FIG. 1 and a sequence connecting the lamps to a pressure source 14 will be seen in FIG. 2.

The apparatus comprises a stationary circular lower slide 38, also known as a "distributor" or "stator", a circular upper slide 36 known also as a "runner" or "rotor" is mounted rotatably above the lower slide. Upper member 36, which is rotatable about vertical axis 80, mounts a holding member 28, which is the "pump connecting piece", in which the stem 22 of a glass lamp bulb 12 is fixed. Leads 30, 32 communicate with the lamp connecting piece 18. Lead 30 supplies sweeping or filling gas to the interior 10 of the bulb. Evacuation takes place through lead 32.

Vertical passageways 50, 52 are formed in the lower stator 38 for communication with the pressure and vacuum sources. Passageways 50, 52 are connected by pipe leads 54, 56 to the pressure source 14 and the sweeping or filling gas and with vacuum sources 16, 17, respectively.

The interior 10 of the "stem lamp" comprising the glass lamp bulb 12 and the stem 22 is evacuated by the apparatus in the position shown in FIG. 1 and filled with gas when in the position shown in FIG. 2.

One function of the apparatus resides in fully pumping down interior 10 by the aid of the vacuum source and thereafter in melting off or sealing off stem 22. The method is employed for producing so-called vacuum lamps. A second function resides in a pumping-sweeping cycle of the interior 10, which is followed by filling interior 10 with a preferredly inert gas. Subsequently, the stem 22 is melted or sealed off.

The slide system 36, 38 creates connections between the vertical passageways 50, 52 in lower slide 38 and lateral passageways 42, 43 in the upper slide 36 at different positions of rotation of the upper slide 36, i.e., the slide system 36, 38 performs a valve function. In the lower slide 38, the passageway 50 terminates in an opening 58 in the upper surface 60 of the slide 38, which surface engages the lower surface 46 of the upper slide 36. Opening 53 communicates with an opening 44 in lower surface 46 of the upper slide 36, which in turn communicates with the lateral passageway 42 in the upper slide.

During the pumping-down of the interior of the bulb 10 which takes place during a standstill of upper slide 36, the openings 44 and 53 of the passageways 32 and 52 respectively are in communication with each other. During a sweeping/filling step, openings 48 and 58 are in communication with each other. The period of time during which the openings are in communication is called resting time. Upon termination of this step, the upper slide 36 is rotated until other passageways are in communication for carrying out the next step. The time spent in rotation is called switching time. The sum of the resting and the switching time is the station time for the respective step. In such case, the pumping-down, sweeping and filling takes place when the appropriate passageways are in communication.

The lower slide 38 comprises a circular ring, open in the center, made, for example, of steel, and a circular ceramic disc 64. The disc is secured to the upper surface 62 of lower slide 38. Preferably, the ceramic disc 64 is adhered to the surface 62. The ceramic material of which the disc is made is extremely wear resistant and has a low coefficient of friction with other materials. Preferably, the disc 64 is formed from a of ceramic oxide. Materials which are particularly suited are alumina or zirconium oxide. Passageways 50, 52 are extended in disc 64 by communication bores, which terminate in the upper surface.

Surface 62 has a circular edge 68 which centers disc 64 and protects it against lateral shifting.

In disc 64, close to the outer periphery and the inner circular opening are annular grooves **72, 72*a*, 74, 74*a*. These grooves are formed in the surface 60. There are also annular grooves 76, 76*a*, 78, 78*a* in the surface 62 of the lower slide 38, which are located at approximately the same radial distance from center axis 80 of lower slide 38 as are grooves 72, 72*a*, 74, 74*a*. Grooves 76, 76*a*, 78, 78*a*, however, have a larger cross section than grooves 72, 72*a*, 74, 74*a*. Grooves 72, 72*a* and 76, 76*a* as well as 74, 74*a* and 78, 78*a* are connected with one another by vertical bores 82 in disc 64 which bores are uniformly spaced along the bottoms of the grooves. Grooves 76, 76*a*, 78, 78*a* are connected through bores 84, 84*a*, 86, 86*a* with the vacuum source 16, 17**.

The upper face 60 and lower face 46 contact each other in the assembled state of the slide system. Lower surface 46 is pressed by the weight of the upper slide 36 and the members supported by it against the upper surface 60, with a predeterminable pressure. The two surfaces 46, 60 are planar, being formed by grinding and exhibit very minor interspaces or surface irregularities such as scratches.

Air penetrating the interspaces from the atmosphere is removed by vacuum sources 16, 17 via grooves **72, 72*a*, 74, 74*a*. With the application of pressure to the passageway 50 and other passageways not shown, gas entering into said interspaces from opening 58 is removed via grooves 72, 72*a*, 74, 74*a*. Accordingly, an especially good sealing between upper and lower slides 36, 38 is achieved by the vacuum acting through the grooves 72, 72*a*, 74, 74*a***.

Owing to the good sliding properties of the ceramic material of disc 64, the use of oil to achieve a sealing between the upper and lower slides 36, 38 is rendered superfluous. For this reason, during the sweeping and filling procedures no oil and no atmospheric gases can get into the interior 10 of the bulb 12. Difficulties caused by such impurifications do not arise. This is why a higher lamp quality can be attained by apparatus made in accordance with the invention. Moreover, effort of oil control and re-filling necessary with oil-sealed slide systems, is eliminated.

The upper slide 36 may also be provided with a ceramic sliding surface, as for example, affixing a disc of ceramic oxide to its lower face 46. Such measure may be taken, for example, for improving the friction properties.

I claim:

1. Apparatus for producing consecutive connections between the interiors of glass lamp bulbs and sources of pressurized gasses and/or vacuum in a sequence comprising:

a stationary, circular, lower slide having a flat upper face, a rotatable, circular, upper slide having a flat face engagable with the lower slide, passageways in the lower slide in communication with sources of pressurized gasses and/or vacuum and terminating in the upper face, second passageways in the upper slide in communication with the interiors of glass lamp bulbs carried by the upper slide and terminating in the lower face, the circular slides rotatable relative to each other to place the passageways in the upper and the lower slide in communication, at least one of the two slides being provided with a circular ceramic insert having a flat face engagable with the face of the other slide, the ceramic material being highly resistant to wear and having a low coefficient of friction, the circular ceramic insert being recessed into the slide and surrounded by a circular projecting edge which surrounds the circumference of the ceramic disc, passageways in the ceramic insert communicating with the passageways in the slide in which it is inserted, the passages in the ceramic disc terminating in its flat face in order to communicate with the passageways in the other slide, and, the ceramic insert having at least two circular grooves in its face, one located near its outer and one near its inner edge, the grooves being in open communication with the face of the other slide and connected to a vacuum source to remove air penetrating the interspace between the face of the ceramic insert and the face of the other slide.

2. Apparatus according to claim 1, wherein the ceramic insert consists of ceramic oxide.

3. Apparatus according to claim 1, wherein the ceramic disc is inserted in the upper slide.

4. Apparatus according to claim 1, wherein the ceramic disc is inserted in the lower slide.

5. Apparatus according to claim 1, wherein the ceramic disc is adhered to the slide.

6. Apparatus for producing consecutive connections between the interiors of glass lamp bulbs and sources of pressurized gasses and/or vacuum in a sequence comprising:

a stationary, circular, lower slide having a flat upper face, a rotatable, circular, upper slide having a flat face engagable with the lower slide, passageways in the lower slide in communication with sources of pressurized gasses and/or vacuum and terminating in its upper face, second passageways in the upper slide in communication with the interiors of glass lamp bulbs carried by the upper slide and terminating in its lower face, the circular slides being rotatable relative to each other to place the passageways in the upper and the lower slide in communication, at least one of the two slides being provided with a circular ceramic insert having a flat face engagable with the face of the other slide, the ceramic material being highly resistant to wear and having a low coefficient of friction, passageways in the ceramic insert community with the passages in the slide in which it is inserted, the passages in the ceramic disc terminating in its flat face in order to communicate with the passageways in the other slide, the ceramic insert having at least two circular grooves in its face, one near its outer and one near its inner edge, the grooves being in open communication with the face of the other slide, the slide having the ceramic insert having circular grooves disposed at the same radial distance as the grooves in the ceramic disc, the grooves in the slide and the grooves in the ceramic disc being corrected by passageways, and the groove in the slide being connected to a vacuum source to remove air penetrating the interspace between the face of the ceramic insert and the face of the other slide.

7. Apparatus according to claim 6 wherein the passageways connecting the grooves in the discs with the grooves in the slide are located at uniform distances from each other.

8. Apparatus according to claim 6 wherein the circular ceramic insert is recessed into the slide and is surrounded by a circular projecting edge of the slide which surrounds the circumference of the disc.

* * * * *